United States Patent [19]

Vartanian et al.

[11] 4,292,047

[45] Sep. 29, 1981

[54] BENZOQUINONE AND AMINE REACTION PRODUCT FOR FUELS AND MINERAL OILS

[75] Inventors: Paul F. Vartanian; Joseph B. Biasotti, both of Wappingers Falls, N.Y.

[73] Assignee: Texaco Inc., White Plains, N.Y.

[21] Appl. No.: 811,668

[22] Filed: Jun. 30, 1977

[51] Int. Cl.[3] ..... C10L 1/18; C10M 1/32

[52] U.S. Cl. ..... 44/65; 44/73; 44/75; 252/392; 252/51.5 R; 260/396 R; 260/396 N

[58] Field of Search ..... 260/396 N, 396 R; 44/73, 65, 75; 252/392, 51.5 R

[56] References Cited

U.S. PATENT DOCUMENTS

| | | | |
|---|---|---|---|
| 2,686,814 | 8/1954 | Jones | 44/65 |
| 2,739,048 | 3/1956 | Thompson et al. | 44/65 |
| 3,226,425 | 12/1965 | Barrett | 44/65 |
| 3,682,980 | 8/1972 | Braid et al. | 260/396 R |

FOREIGN PATENT DOCUMENTS

| | | | |
|---|---|---|---|
| 587013 | 4/1947 | United Kingdom | 44/65 |

*Primary Examiner*—Winston A. Douglas
*Assistant Examiner*—Raymond K. Covington
*Attorney, Agent, or Firm*—Carl G. Ries; Robert A. Kulason; James J. O'Loughlin

[57] ABSTRACT

A benzoquinone and hydrocarbyl amine reaction product having detergent and corrosion inhibiting properties for fuel and lubricant compositions is provided.

4 Claims, No Drawings

BENZOQUINONE AND AMINE REACTION PRODUCT FOR FUELS AND MINERAL OILS

BACKGROUND OF THE INVENTION

1. Field of the Invention

Internal combustion gasoline engine design is undergoing important changes to meet stricter emission standards set for engine and exhaust gas emissions. A significant change in engine design is the feeding of blow-by gases from the crankcase zone of the engine into the intake air-fuel mixture near the throttle plate of the carburetor rather than venting these gases to the atmosphere as was practiced formally. This blow-by gas contains substantial amounts of deposit-forming substances and it is known to form deposits in and around the throttle plate area of the carburetor. Another significant change in engine design and operation is the recirculation of a part of the exhaust gases to the fuel air intake of the engine. These exhaust gases also have a pronounced deposit-forming tendency. The carburetor deposits produced by the blow-by gases and the recycled exhaust gases restrict the flow of air through the carburetor at idle and at low speeds so that an over-rich fuel mixture results. This condition produces rough engine idling and/or stalling and leads to the release of excessive hydrocarbon emissions to the atmosphere.

Another problem associated with internal combustion engine operation relates to the crankcase lubricant and its use. Crankcase lubricating oils are inevitably contaminated with foreign substances such as dirt, water and decomposition products from the combustion process or from the breakdown of the lubricating oil itself. Significant amounts of sludge can be produced in the crankcase of an engine as a result of the presence of foreign matter and this sludge tends to adhere to the walls and passages in the engine. A particularly serious problem arises when the sludge in the crankcase lubricant deposits in the small passageways of the engine, thereby restricting the flow of the lubricating oil to bearings and valves in the engine. In the more serious instances, the oil flow through the oil passageways tends to be completely restricted resulting in a failure of the system to lubricate critical engine bearing surfaces. This condition leads to excessive cam shaft wear and ultimately to reduced engine life. An effective detergent in the cranckcase lubricating oil serves to keep the foreign substances dispersed in the oil and also improves the effectiveness of the oil filter to remove a substantial amount of the foreign matter from the oil.

Another problem which always occurs where fuel and oil compositions are employed is the problem of corrosion. Engines and metal components in contact with a mineral oil and, more particularly, when they are employed in an environment that permits contact of the oil composition with water or water vapor tend to exhibit damage from corrosion. Additives which can impart effective corrosion-inhibiting properties to an oil composition while at the same imparting other useful characteristics such as detergent properties are particularly attractive additives for fuels and lubricants.

Another problem with oil and fuel additives is the matter of extraction by water bottoms in tanks and storage vessels. Additives which resist or minimize extraction by water substantially extend their effectiveness and are economically attractive for this reason.

2. The Prior Art

U.S. Pat. No. 3,303,007 discloses a motor fuel composition containing a dioleate salt of N-oleyl-1-3-propylenediamine in combination with methanol which exhibits the properties of reducing engine wear.

N-alkyl derivatives of 1,3-propanediamine are commercially available as gasoline and fuel oil addtives.

SUMMARY OF THE INVENTION

An oil-soluble, ashless detergent and corrosion inhibitor is provided which is the reaction product of a benzoquinone, represented by the formula:

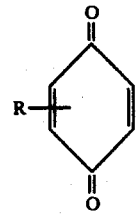

in which R is hydrogen or an alkyl radical having from 1 to 6 carbon atoms, and an amine, represented by a formula selected from the group consisting of $$RNHR'' \text{ and } R'_2NR''$$

in which R is a monovalent hydrocarbon radical having from 8 to 30 carbon atoms, R′ is a monovalent hydrocarbon radical having from 6 to 12 carbon atoms, and R″ represents hydrogen or an aminoalkyl radical selected from the group consisting of $$-CH_2CH_2CH_2-NH_2 \text{ and } -CH_2CH-_2-NH_2$$

by reacting at least 1.5 moles of said amine per mole of said benzoquinone.

Fuel and lubricant compositions comprising a mixture of hydrocarbons boiling in the motor fuel and lubricating oil boiling ranges containing a minor effective detergent and/or rust inhibiting amount of the novel reaction product of the invention are also provided.

SPECIFIC EMBODIMENTS OF THE INVENTION

The benzoquinone reactant employed for preparing the novel reaction product of the invention is represented by the formula:

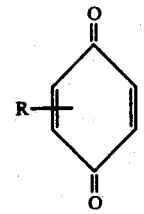

in which R represents hydrogen or an alkyl radical having from 1 to 6 carbon atoms. The effective compounds within this definition include benzoquinone, methylbenzoquinone, ethylbenzoquinone, propylbenzoquinone and butylbenzoquinone.

The amine reactant employed to prepare the reaction product is represented by a formula selected from the group consisting of:

RNHR" and $R'_2NR''$ in which R is a monovalent hydrocarbon radical having from 8 to 30 carbons, R' is a monovalent hydrocarbon radical having from 6 to 12 carbon atoms and R" represents hydrogen or an aminoalkyl radical selected from the group consisting of:

$$—CH_2CH_2CH_2—NH_2 \text{ and } —CH_2CH_2—NH_2$$

A highly effective class of primary amines are those in which R is an aliphatic hydrocarbon radical having from 10 to 18 carbon atoms and R" is hydrogen.

A highly effective class of secondary amines are those in which R' is an aliphatic hydrocarbon radical having from 6 to 10 carbon atoms and R" is hydrogen.

A particularly preferred class of amines are the diamines in which R represents a hydrocarbon radical having from 10 to 18 carbon atoms and R" represents the radical $—CH_2CH_2CH_2—NH_2$.

Examples of effective primary and secondary amines include 2-ethylhexylamine, decylamine, dodecylamine, tetradecylamine, hexadecylamine, octadecylamine, N-ethyl-N-decylamine and N-ethyl-N-dodecylamine.

Examples of effective diamines include dihexylamine, di-(2-ethyl hexyl) amine, dinonylamine and didecylamine.

Typical examples of the diamines include N-oleyl-1,3-propylene diamine, N-lauryl-1,3-propylene diamine, N-tallow-1,3-propylene diamine, N-stearyl-1,3-propylene diamine, N-tallow-1,2-ethylene diamine and N-soya-1,2-ethylene diamine.

The reaction product of the invention is prepared by reacting at least 1.5 moles of the prescribed amine with 1 mole of the prescribed benzoquinone reactant. It is preferred, however, to react from about 1.8 to 2 moles of the amine per mole of the benzoqinone. No particular advantage is realized by reacting a substantially higher ratio of amine with the benzoquinone because the ratio of 2:1 appears to be a theoretical limit in the formation of the adduct.

The reaction for the formation of the adduct is preferably conducted in an inert solvent for the reactants. A relatively inert hydrocarbon solvent is suitable with xylene being a particularly preferred material.

Formation of the reaction product is readily accomplished by contacting the prescribed proportions of the reactants in the solvent and heating the mixture to effect the reaction. The reaction temperature is not critical and, in general, any temperature ranging from about room temperature up to the decomposition temperature of the reactants and reaction product can be employed. It is most efficient, however, to conduct the reaction at the reflux temperature of the solvent being employed. Hydrocarbon solvents boiling in the range from about 130° to 220° C. are particularly suitable for the reaction.

The following examples illustrate the method for preparing the reaction product of the invention.

EXAMPLE I 81 grams (0.75 mole) of benzoquinone, 530 grams (1.5 mole) of N-tallow-1,3-diaminopropane and 200 milliliters of xylene are added to a reaction vessel equipped with a stirrer and a reflux condenser. This mixture is heated and refluxed for about three hours, after which it is cooled and filtered to remove unreacted starting materials. The solvent is removed to yield about 560 grams of the reaction product.

EXAMPLE II 81 grams (0.75 mole) of benzoquinone, 530 grams (1.5 mole) of N-soya-1,3-diaminopropane and 200 milliliters of xylene are reacted as in Example I above. On removal of the solvent by distillation, a substantial yield of the reaction product designated benzoquinone-N-soya-1,3-diaminopropane is recovered.

EXAMPLE III

A mixture of 108 grams (1.0 mole) of benzoquinone, 700 grams (2.0 moles) of N-oleyl-1,3-diaminopropane, and 270 grams of a paraffinic oil having an SUS viscosity at 100° F. of 100 are heated to 200° for three hours, after which it is cooled and filtered to remove unreacted starting material. The reaction yields approximately 1060 grams of material which is 75% active in the desired product any may be used without further modification.

The reaction product of the invention is useful as a detergent and/or a corrosion inhibitor for hydrocarbon fuels, mineral oils and lubricating oil compositions. In general, the reaction product of the invention is effective as a carburetor detergent and/or corrosion inhibitor in a motor fuel composition comprising a mixture of hydrocarbons in the gasoline boiling range, i.e., from about 90° to 425° F. Broadly effective concentrations as detergent and corrosion inhibitors in fuels range from about 0.005 to 0.20 weight percent of the reaction product based on the weight of the gasoline composition. A preferred concentration of the reaction product in gasoline is an amount ranging from about 0.002 to 0.04 weight percent which corresponds to about 5 and about 100 PTB (pounds of additive per 1000 barrels of gasoline), respectively.

In oil compositions the reaction product can be employed at concentrations ranging from about 0.0005 to 10 weight percent with a preferred concentration being from 0.01 to 5 weight percent based on the total weight of the oil composition.

The effectiveness of the reaction product of the invention as a carburetor detergent was tested in the Chevrolet Carburetor Detergency Test designed to remove preformed deposits from the throttle plate area of a carburetor. This test is run using a Chevrolet V-8 engine mounted on a test and fitted with a modified four-barrel carburetor. The two secondary barrels of the carburetor are sealed and the feed to each of the primary barrels arranged so that the detergent additive fuel can run in one barrel and the reference fuel can run in the other. The primary carburetor barrels are also modified to contain removable aluminum inserts in the throttle plate area so that the deposits adhering to the inserts may be conveniently weighed.

The engine is run for a period of time, usually 24 or 48 hours, using base fuel as the feed to both carburetor barrels with engine blow-by circulated to the carburetor air inlet. The weight of the deposits thus formed is measured and recorded. The inserts are returned to the carburetor and the engine is run on a test cycle for 24 hours with base fuel containing a recognized commerical detergent at a concentration of 105 PTB being fed to one barrel and base fuel containing the test additive being fed to the other. Again, engine blow-by is circulated to the carburetor air inlet during the test cycle. Upon completion of the test cycle, the inserts are removed from the carburetor and weighed to determine the difference between the performances of the test additive and the commerical detergent fuel. After the aluminum inserts have been cleaned and replaced in the carburetor the process is repeated with the fuel feeds to the carburetor in the test cycle reversed to minimize any differences in fuel distribution or carburetor construction. The results obtained in the two runs are averaged and the effectiveness of the additive fuel in removing deposits is expressed in percent.

The base fuel employed in this and in the subsequent tests was a premium grade gasoline having a Research Octane Number of about 99.6 and contained about 2.97 cc of tetraethyl lead per gallon. This gasoline consisted of about 32% aromatic hydrocarbons, 8% olefinic hydrocarbons and 60% paraffinic hydrocarbons and boiled in the range from about 95° F. to 363° F.

The results obtained in the Chevrolet Carburetor Detergency Test using the above-described base fuel and the indicated additives are set forth in Table I below.

TABLE I

CHEVROLET CARBURETOR DETERGENCY TEST

| Run | Base Fuel + Additive | Deposit, mg. Build-up | Deposit, mg. Removal | Effectiveness,% |
|---|---|---|---|---|
| 1 | Base Fuel - no additive | 16.8 | −1.7 | −10 |
| 2 | Benzoquinone-N-oleyl-1,3-diaminopropane adduct (Example III)[a] | 22.2 | 20.1 | 91 |
| 3 | Benzoquinone-N-tallow-1,3-diaminopropane adduct (Example I)[a] | 23.7 | 17.9 | 75 |
| 4 | Commercial detergent additive (A) | 36.7 | 13.3 | 36 |
| 5 | Commercial detergent additive (B) | 21.8 | 17.1 | 78 |

[a]Additives at 50 pounds/thousand barrels in Base Fuel.

The foregoing tests show that the reaction product of the invention was highly effective as a gasoline carburetor detergent for removing performed deposits from the throttle plate area of a carburetor being equal or superior to well-known commerical detergent additives.

The reaction product of the invention was also tested for its carburetor detergency in the Buick Carburetor Detergency Test which measures the ability of an additive to prevent deposit build-up on an initially clean carburetor. This test uses a 1973 Buick 350 CID V-8 engine equipped with a two-barrel carburetor. The engine is mounted on a dynamometer test stand and has operating EGR, AIR, and PCV systems. The test cycle shown below is representative of normal road operation. Approximately 300 gallons of fuel and three quarts of oil required for each run.

Prior to each run the carburetor is completely reconditioned. Upon completion of the run the throttle plate deposits are rated visually according to a merit rating scale of one to ten, with "one" applied to extremely heavy deposits on the throttle plate and "ten" to a completely clean plate.

1973 Buick Carburetor Detergency Test Operating Conditions

| | Stage I | Stage II | Stage III |
|---|---|---|---|
| Duration, hrs. | 1 | 3 | 1 |
| Speed, rpm | 650 ± 25 | 1500 ± 25 | 2000 ± 25 |
| Torque, ft.-lbs. | 0 | 80 ± 2 | 108 ± 2 |
| Water Out, °F. | 205 ± 5 | 205 ± 5 | 205 ± 5 |
| Carburetor Air, °F. | 140 ± 5 | 140 ± 5 | 140 ± 5 |
| Exhaust Back Pressure, | | 0.7 ± 0.1 | |

-continued

1973 Buick Carburetor Detergency Test Operating Conditions

| | Stage I | Stage II | Stage III |
|---|---|---|---|
| in. Hg | | | |
| Man. Vac., in. Hg | | 15.8 | 14.2 |
| Fuel Flow, lbs./hr. | 0.7 | 7.5 | 12.0 |
| Test Duration, 120 hours. | | | |

The results obtained in the Buick Carburetor Detergency Test are set forth in Table II below.

TABLE II

BUICK CARBURETOR DETERGENCY TEST

| Additive | Dosage, PTB[a] | Rating |
|---|---|---|
| Base Fuel - no additive | — | 3.0 |
| Benzoquinone N-oleyl-1,3-diaminopropane adduct (Example III) | 5 | 6.7 |
| | 10 | 7.9 |
| | 15 | 8.2 |
| Benzoquinone-N-tallow-1,3-diaminopropane adduct (Example I) | 5 | 7.3 |
| | 7.5 | 7.8 |
| | 10 | 8.2 |
| | 15 | 8.2 |
| Commercial detergent | 15 | 5.0 |

[a]Dosage on a diluent free basis

This test shows that the reaction product of the invention was highly effective for preventing the build-up of deposits in a carburetor and substantially exceeded the performance of a known commercial carburetor detergent.

The ability of the additive to provide corrosion protection was tested in a Rust Test (similar to the ASTM D-665 procedure). In this test, a polished steel spindle is suspended in 300 ml. of additive test fuel at 100° F. for one-half hour. At the end of this time, 30 ml. of water are added and the stirred mixture is continued at 100° F. for 3½hours. At the end of this time the steel spindle is examined visually for signs of rust with the rating expressed in percent of area covered by rust. The test fuel used was the Base Fuel described above.

TABLE III

RUST TEST

| Run | Additive | Dosage, PTB[a] | Rating % Rust |
|---|---|---|---|
| 1 | None | — | 50–100 |
| 2 | Benzoquinone-N-oleyl-1,3-diaminopropane (Example III) | 25 | Trace |
| 3 | Benzoquinone-N-oleyl-1,3-diaminopropane (Example III) | 5 | 1–5 |
| 4 | Benzoquinone-N-tallow-1,3-diamino-propane (Example I) | 50 | 1–5 |

[a]Dosage on a diluent free basis.

The reaction product of the invention was effective for substantially reducing the rust tendencies of a gasoline motor fuel composition.

The foregoing tests demonstrate the effectiveness of the reaction product of the invention as a detergent and corrosion inhibitor in motor fuel compositions. The reaction product is effective in motor fuel, mineral oil and lubricating oil compositions and may be employed therein in conjunction with conventional mineral oil additives.

We claim:

1. A motor fuel composition comprising a mixture of hydrocarbons within gasoline boiling range containing from about 0.005 to 0.20 weight percent of a reaction product prepared by reacting benzoquinone with an amine selected from the group consisting of N-oleyl-1,3-diaminopropane, N-lauryl-1,3-diaminopropane, N-soya-1,3-diaminopropane, and N-tallow-1,3-diaminopropane, said reaction product being prepared by reacting at least 1.5 moles of said amine per mole of said benzoquinone.

2. A motor fuel composition according to claim 1 in which said amine is N-soya-1,3-diaminopropane.

3. A motor fuel composition according to claim 1 in which said amine is N-oleyl-1,3-diaminopropane.

4. A motor fuel composition according to claim 1 in which said amine is N-tallow-1,3-diaminopropane.

* * * * *